US010879662B2

(12) United States Patent
Park et al.

(10) Patent No.: US 10,879,662 B2
(45) Date of Patent: Dec. 29, 2020

(54) ELECTRIC CONTACT TERMINAL, METHOD AND STRUCTURE AND APPARATUS FOR MOUNTING THE SAME

(71) Applicant: JOINSET CO., LTD., Ansan-si (KR)

(72) Inventors: Kee-Han Park, Ansan-si (KR); Tae-Man Kang, Ansan-si (KR); Byung-Sun Jung, Ansan-si (KR); Sun-Ki Kim, Gunpo-si (KR); Gyu-Seop Kim, Ansan-si (KR); Eung-Won Kim, Ansan-si (KR); Se-Deok Oh, Ansan-si (KR)

(73) Assignee: JOINSET CO., LTD.

( * ) Notice: Subject to any disclaimer, the term of this patent is extended or adjusted under 35 U.S.C. 154(b) by 0 days.

(21) Appl. No.: 16/391,450

(22) Filed: Apr. 23, 2019

(65) Prior Publication Data

US 2019/0326719 A1 Oct. 24, 2019

(30) Foreign Application Priority Data

| | | |
|---|---|---|
| Apr. 23, 2018 | (KR) | 10-2018-0046491 |
| Apr. 28, 2018 | (KR) | 10-2018-0049484 |
| May 15, 2018 | (KR) | 10-2018-0055436 |
| May 31, 2018 | (KR) | 10-2018-0062954 |
| Jun. 5, 2018 | (KR) | 10-2018-0065101 |
| Oct. 19, 2018 | (KR) | 10-2018-0125130 |

(51) Int. Cl.

| | |
|---|---|
| ***H01R 4/66*** | (2006.01) |
| ***H01R 43/04*** | (2006.01) |
| ***H01R 4/04*** | (2006.01) |
| ***H01R 13/03*** | (2006.01) |
| ***H01R 13/22*** | (2006.01) |
| ***H01R 4/10*** | (2006.01) |
| *H01R 12/71* | (2011.01) |

(52) U.S. Cl.

CPC ..... *H01R 43/04* (2013.01); *H01R 4/04* (2013.01); *H01R 4/10* (2013.01); *H01R 13/03* (2013.01); *H01R 13/22* (2013.01); *H01R 12/714* (2013.01)

(58) Field of Classification Search

CPC ..... H01R 13/648; H01R 13/6485
USPC ..... 439/92, 95
See application file for complete search history.

(56) References Cited

U.S. PATENT DOCUMENTS

| | | | | |
|---|---|---|---|---|
| 4,976,626 A * | 12/1990 | Dibble | H01R 12/62 | 439/67 |
| 5,073,118 A * | 12/1991 | Grabbe | H01R 12/58 | 439/71 |
| 5,984,692 A * | 11/1999 | Kumagai | H05K 3/368 | 439/66 |
| 6,456,504 B1 * | 9/2002 | LoForte | H05K 5/0269 | 361/737 |
| 7,794,242 B2 * | 9/2010 | Shi | H05K 9/0016 | 439/92 |

(Continued)

*Primary Examiner* — Phuong K Dinh
(74) *Attorney, Agent, or Firm* — Park & Associates IP Law, P.C.

(57) ABSTRACT

An electric contact terminal configured to be forcibly inserted into an accommodation recess formed in a surface of an electrically conductive object and thus be reliably mounted on the electrically conductive object. The electric contact terminal includes: a metal body having a flat surface on at least an upper side thereof; and at least two projections protruding from a lateral side of the body, wherein the projections are sized such that the projections are placed on an edge of the accommodation recess.

7 Claims, 11 Drawing Sheets

(56) References Cited

U.S. PATENT DOCUMENTS

| | | | | |
|---|---|---|---|---|
| 7,887,337 | B1 * | 2/2011 | Yuan | H01R 13/6485 439/76.1 |
| 8,602,830 | B2 * | 12/2013 | Ito | H01M 2/1066 439/876 |
| 9,966,685 | B2 * | 5/2018 | Kim | H01R 13/03 |
| 10,128,584 | B2 * | 11/2018 | Kim | H01R 4/58 |
| 10,777,920 | B2 * | 9/2020 | Park | H04M 1/0202 |

* cited by examiner

ELECTRIC CONTACT TERMINAL, METHOD AND STRUCTURE AND APPARATUS FOR MOUNTING THE SAME

REFERENCE TO RELATED APPLICATIONS

This application claims the priority benefit of Korean Patent Application No. 10-2018-0046491 filed on Apr. 23, 2018, Korean Patent Application No. 10-2018-0049484 filed on Apr. 28, 2018, Korean Patent Application No. 10-2018-0055436 filed on May 15, 2018, Korean Patent Application No. 10-2018-0062954 filed on May 31, 2018, Korean Patent Application No. 10-2018-0065101 filed on Jun. 5, 2018 and Korean Patent Application No. 10-2018-0125130 filed on Oct. 19, 2018, the entire contents of which are incorporated herein by reference.

FIELD OF THE INVENTION

The present invention relates to an electric contact terminal, and more particularly, to an electric contact terminal configured to be fitted into an accommodation recess formed in a metal case of an electronic device for contact with an elastic conductive clip, and a structure, method, and apparatus for mounting the electric contact terminal.

BACKGROUND OF THE INVENTION

Nonferrous metals, such as aluminum, aluminum alloys, magnesium, or magnesium alloys which are light in weight, inexpensive, and easy to process, are mainly used for manufacturing metal cases of electronic communication devices such as cellular phones.

Such metal cases formed of nonferrous metals are vulnerable to corrosion in the atmosphere or according to environmental changes and have low strength, and thus surface treatments such as coating or plating may be performed to prevent corrosion of such metal cases.

However, electrical resistance increases due to surface treatments performed on aluminum, aluminum alloys, magnesium, or magnesium alloys to prevent corrosion. In this case, a post processing process such as grinding may have to be performed to remove a surface-treated portion from an electrical contact portion of a case that will be brought into contact with an elastic terminal mounted on a circuit board, so as to reduce electrical resistance.

However, the electrical contact portion which is peeled by grinding is eventually corroded as being exposed to the outside.

As the electrical contact portion is corroded as described above, the electrical resistance of the electrical contact portion increases unevenly, thereby increasing the electrical resistance between the electrical contact portion and an opposing electrically conductive object. In this case, particular, the RF performance or transmission/reception performance of RF devices or antennas may decrease.

In addition, since the mechanical strength of the surface of a metal case formed of aluminum, an aluminum alloy, magnesium, or a magnesium alloy is relatively low, if an elastic electrical terminal mounted on a circuit board and formed of a metal having high mechanical strength and elasticity is mechanically repeatedly brought into contact with the metal case, a surface contact portion of the metal case may be easily abraded or worn, and thus it may be difficult to continuously provide reliable electrical contact.

As described above, when a case of a device such as a smartphone is formed of aluminum, an aluminum alloy, magnesium, or a magnesium alloy which easily undergoes surface corrosion and has low mechanical strength, the case may not reliably make electrical contact with an opposing electrical terminal formed of an elastic metal, thereby resulting in poor RF performance and transmission/reception performance.

In order to solve these problems, an electric contact terminal has been proposed in the related art, which includes: a body configured to be welded to a surface of an electrically conductive object formed of aluminum, an aluminum alloy, magnesium, or a magnesium alloy, the body including a metal core and plating layers respectively formed on the upper and lower surfaces of the metal core; a contact layer formed on an outer surface of the body, the outer surface including at least an upper surface of the body; and an adhesive tape adhered to a lower surface of the body, wherein the body and the electrically conductive object are melted together by welding to form a weld layer between the lower surface of the body and the surface of the electrically conductive object, and the electric contact terminal and the electrically conductive object are mechanically and electrically connected to each other through the weld layer.

As described above, in the related art, since a welding process is required to fix the electric contact terminal, although the electric contact terminal is temporarily fixed using the adhesive tape, the position of the electric contact terminal may be deviated because of vibration during the welding process such as an ultrasonic welding process, vibration or impact occurring while the electric contact terminal is handled. For example, when one of a plurality of electric contact terminals is welded to a case, the other adjacent electric contact terminals waiting for welding may be separated.

In addition, since the material of a case and the material of an electric contact terminal having an plating layer are greatly different, it is difficult to join the case and the electric contact terminal by welding between different metals. Thus, the coupling strength between the case and the electric contact terminal may be insufficient, and thus the electric contact terminal may be separated from the case when being impacted. For example, the outermost layers of the plating layers may be formed of gold and may not be melted at a temperature at which the case formed of an aluminum alloy is melted, and thus it is difficult to provide a reliable weld joint by welding between the gold and the aluminum alloy.

In addition, since the material of the case and the material of the electric contact terminal are different from each other, portions of the electric contact terminal and the case formed of a metal that are brought into contact with each other and welded together may undergo an electrochemical change (such as galvanic corrosion), and thus electrical signals may be attenuated or distorted.

In addition, if the electric contact terminal is small, it is difficult to automatically mount the electric contact terminal using the adhesive tape adhered to the lower surface of the electric contact terminal.

SUMMARY OF THE INVENTION

Accordingly, an object of the present invention is to provide an electric contact terminal configured to be economically and reliably mounted on a metal case by a vacuum pickup surface mounting method without having to perform a welding process.

Another object of the present invention to provide an electric contact terminal that may be easily physically inserted into an accommodation recess formed in a metal case and may not be easily separated from the accommodation recess by vibration or impact during transportation or handling.

Another object of the present invention is to provide an electric contact terminal having low galvanic corrosion at a portion making contact with a metal case and low insertion loss.

Another object of the present invention is to provide an electric contact terminal having improved wear resistance with respected an elastic clip that faces and makes contact with the electric contact terminal.

Another object of the present invention is to provide an inexpensive automatic mounting apparatus configured to mechanically and electrically insert electric contact terminals into accommodation recesses of cases in a continuous and accurate manner.

Another object of the present invention is to provide a mounting apparatus configured to mechanically insert various electric contact terminals into variously shaped accommodation recesses of metal cases in an easy and reliable manner.

According to an aspect of the present invention, there is provided an electric contact terminal configured to be inserted into an accommodation recess of a metal case, the electric contact terminal including: a metal body having a flat surface on at least an upper side thereof; and at least two projections protruding from a lateral side of the body, wherein the projections are sized such that the projections are placed on an edge of the accommodation recess.

According to another aspect of the present invention, there is provided an electric contact terminal configured to be inserted into an accommodation recess of a metal case, the electric contact terminal including: a metal body having a flat surface on at least an upper side thereof; at least two projections protruding from a lateral side of the body; and a recess formed in a lower surface of the body, wherein a plating layer is formed on an entire surface of the body by using nickel, gold, or a gold alloy.

According to another aspect of the present invention, there is provided a structure for mounting an electric contact terminal in an accommodation recess of a metal case, the electric contact terminal including: a metal body having a flat surface on at least an upper side thereof; and a deformable portion formed in one piece with the body by outwardly protruding a lateral portion of the body, wherein the electric contact terminal is press fitted into the accommodation recess by physically pressing the deformable portion to deform the deformable portion and is bonded to the accommodation recess using an adhesive.

According to another aspect of the present invention, there is provided a method for mounting an electric contact terminal in an accommodation recess of a metal case, the electric contact terminal including a metal body and at least two projections protruding from a lateral side of the body, the method including: discharging a predetermined amount of adhesive to the accommodation recess; picking up the electric contact terminal using a pickup device to mount the electric contact terminal in the accommodation recess; forcibly pressing the electric contact terminal into the accommodation recess by pressing the body using a pressing tool of the pickup device, or by pressing the body at once using an additional jig after the electric contact terminal is surface mounted; and curing the adhesive, wherein the body is mechanically coupled to the accommodation recess as the projections are deformed by the pressing and is bonded to the accommodation recess by the cured adhesive.

According to another aspect of the present invention, there is provided an apparatus for mounting an electric contact terminal in an accommodation recess of a metal case, the electric contact terminal including a metal body and at least two projections protruding from a lateral side of the body, the apparatus including: a dispenser configured to discharge a predetermined amount of electrically conductive adhesive to the accommodation recess; a tape carrier configured to sequentially supply electric contact terminals; a pick-and-place device configured to pick up an electric contact terminal from the tape carrier and place the electric contact terminal on an entrance of the accommodation recess; and a pusher configured to press an upper portion of the electric contact terminal placed on the entrance of the accommodation recess to push the electric contact terminal into the accommodation recess, wherein the electric contact terminal is mechanically and electrically coupled to the case when the electric contact terminal is inserted into the accommodation recess as the projections are reduced in size by the pusher, and the electric contact terminal is bonded to the case as the discharged adhesive is cured.

According to the above-described configuration, it is possible to more reliably prevent separation of the electric contact terminal owing to the mechanical coupling provided by forcible press fitting and deformation of the projections and the bonding provided by the adhesive provided between the lower surface of the body and the bottom surface of the accommodation recess.

In addition, owing to the use of adhesive, an additional welding process is not necessary.

In addition, since the electric contact terminal can be taped on a reel carrier, the electric contact terminal may be economically and reliably surface mounted in the accommodation recess of the case.

In addition, since the projections push the inner lateral side of the accommodation recess as being deformed in a state in which the electric contact terminal is inserted in the accommodation recess, the electric contact terminal may not be easily separated from the accommodation recess even when the electric contact terminal is vibrated or impacted during transportation or handling.

In addition, since the projections are evenly arranged on the body, the electric contact terminal may have good balance and may thus be easily handled, and since the upper side of the body of the electric contact terminal is flat, the electric contact terminal may be easily picked up by vacuum.

In addition, the occurrence of a galvanic phenomenon may reduce owing to gold plating or because the metal case makes contact with a metal of the same or similar kind.

In addition, since an exposed surface of the electric contact terminal is plated with nickel or gold, the electric contact terminal may have high wear resistance with respect to an electrically conductive elastic clip that makes contact with the electric contact terminal.

In addition, the electric contact terminal may be mechanically coupled to the case by a pressing and insertion method using a single apparatus without ultrasonic or laser welding, and may then be electrically and chemically coupled to the case by using the single apparatus as an electrically conductive adhesive discharged to the bottom surface of the accommodation recess is cured.

In addition, since the adhesive has initial self adhesiveness, the electric contact terminal may be continuously inserted into the accommodation recess in an easy and efficient manner without separation of the electric contact terminal, and after the adhesive is cured, the electric contact terminal may not be easily separated by vibration or impact.

In addition, since the electric contact terminal can be taped on a reel carrier, picked up by vacuum, and placed, the electric contact terminal may be economically mounted. In addition, the electric contact terminal is pushed by the pusher and reliably inserted into the accommodation recess. Therefore, various electric contact terminals may be easily inserted into variously shaped accommodation recesses in an economical and reliable manner.

In particular, when the pusher is provided as part of the pick-and-place device, the mounting apparatus may be inexpensive and have high mounting precision.

In addition, automation may be easily realized owing to the cassette magazines loaded with jigs to which cases are fixed and configured to be continuously fed, the loader configured to supply the cassette magazines to the mounting apparatus, and the unloader configured to receive cassette magazines discharged from the mounting apparatus.

DETAILED DESCRIPTION OF THE INVENTION

Technical terms used in the present invention are only for explaining specific embodiments while not limiting the present invention. In addition, unless otherwise defined, technical terms used in the present invention have the same meaning as commonly understood by those of ordinary skill in the art and will not be interpreted in an overly broad or narrow sense.

In addition, if technical terms used in the present invention are incorrect to exactly express the idea of the present invention, the technical terms should be interpreted as terms by which those of ordinary skill in the art can correctly understand the idea of the present invention. In addition, general terms used in the present invention may be interpreted as defined in dictionaries or according to the contextual meanings, and should not be interpreted in an overly narrow sense.

Hereinafter, specific embodiments of the present invention will be described in detail with reference to the accompanying drawings.

Figure 1:
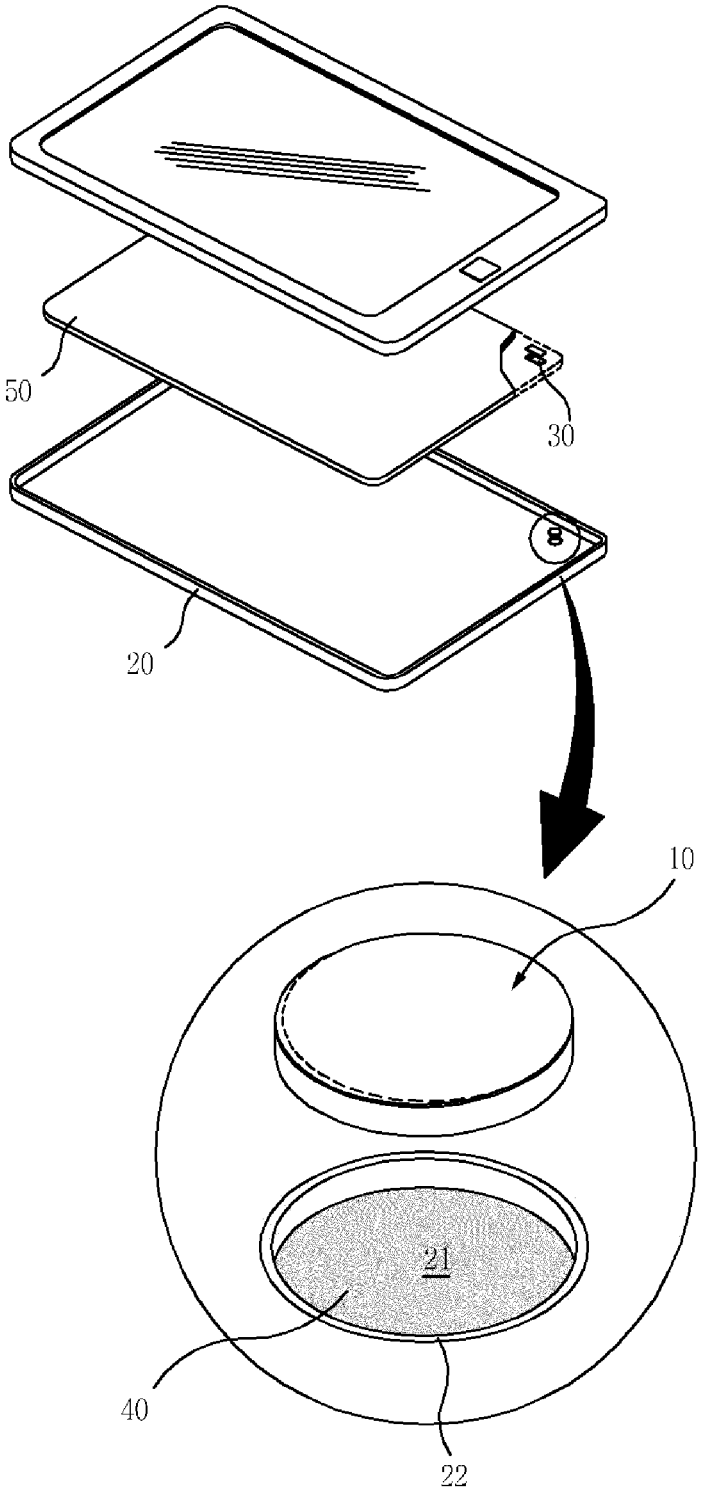
FIG. 1 is an exploded perspective view illustrating an electric contact terminal for application to a metal case.
Figure 2A:
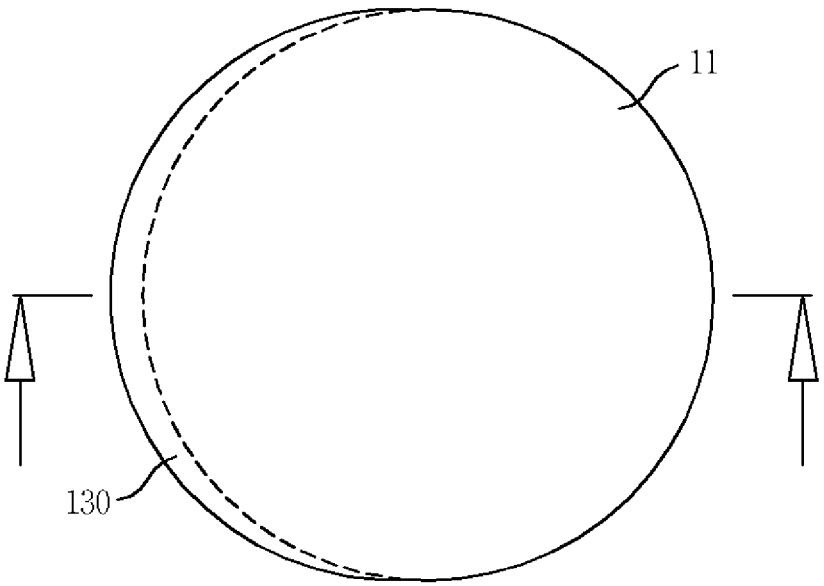
FIGS. 2A and 2B are a plan view and a cross-sectional view illustrating an electric contact terminal according to an embodiment of the present invention.
Figure 2B:
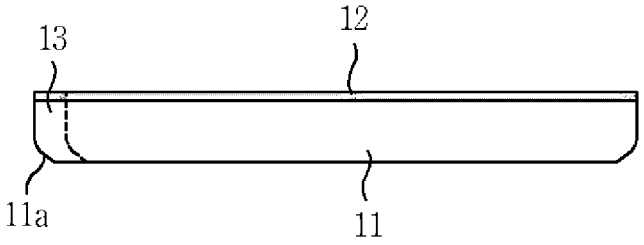

FIG. 1 is an exploded view illustrating an electric contact terminal for application to a metal case, and FIGS. 2A and 2B are a plan view and a cross-sectional view illustrating an electric contact terminal according to an embodiment of the present invention.

The electric contact terminal 10 is forcibly inserted into an accommodation recess 21 formed in a surface of a metal case formed of a lightweight nonferrous metal such as aluminum, an aluminum alloy, magnesium, or a magnesium alloy.

The electric contact terminal 10 has a flat upper surface for facilitating a vacuum pickup process such that the electric contact terminal 10 may be fed in a state in which the electric contact terminal 10 is taped on a reel carrier and may then be vacuum picked up.

In the present embodiment, for example, the electric contact terminal 10 is provided on an inner surface of a lower case 20 of a cellular phone, and an elastic metal clip 30 mounted on a circuit board 50 is mechanically and electrically connected to the electric contact terminal 10.

An accommodation recess 21 having predetermined dimensions is formed in a portion of the lower case 20 with which the elastic metal clip 30 will be brought into contact, and the electric contact terminal 10 is mounted by inserting the electric contact terminal 10 into the accommodation recess 21. For example, the electric contact terminal 10 may be physically inserted into the accommodation recess 21 by a forcibly pressing method and may be additionally bonded by an adhesive 40.

The accommodation recess 21 is formed as part of the lower case 20 by recessing a portion of the lower case 20 using a computer numerical control (CNC) milling machine, and as being named, the accommodation recess 21 does not penetrate the lower case 20 and has a bottom surface.

As described above, the metal clip 30 is mounted on the circuit board 50 at a position facing the electric contact terminal 10, for example, by soldering, and is mechanically and electrically brought into contact with the electric contact terminal 10 mounted on the case 20.

Referring to FIGS. 2A and 2B, the electric contact terminal 10 includes a body 11 and a contact layer 12 formed on a portion of the body 11 that comes into contact with the clip 30.

Alternatively, the electric contact terminal 10 may include the adhesive 40 to bond a projection 13 to the accommodation recess 21.

The contact layer 12 may refer to a portion which directly comes into contact with the clip 30 and may include a material harder than the body 11. For example, the contact layer 12 may be a plating layer including at least a nickel layer. For example, the contact layer 12 may be a nickel plating layer, and a nickel/gold plating layer, a nickel-gold alloy (cobalt) plating layer, or a nickel-nickel alloy (palladium)-gold alloy (cobalt) plating layer may be further formed on the contact layer 12.

In the present embodiment, the contact layer 12 is formed on an upper surface of the body 11. However, this is a non-limiting example. In another embodiment, the contact layer 12 may be formed on the entire outer surface of the body 11.

In particular, the contact layer 12 is a portion that is brought into electrical and mechanical contact with the clip 30, and since the hardness of the nickel layer is greater than the hardness of the case 20 and the contact terminal 10 is mechanically brought into contact with the clip 30, the lower case 20 having relatively low mechanical strength may be protected from friction.

In the present invention, the "hardness" of the electric contact terminal 10 may vary according to a metal alloy used to form the contact layer 12, and it is difficult to measure the hardness of the electric contact terminal 10 because the electric contact terminal 10 is small and the contact layer 12 is very thin. However, when the body 11 of the electric contact terminal 10 and the lower case 20 are formed of the same material or similar materials, a metal alloy having greater hardness than the body 11 may be used to form the contact layer 12, and eventually the lower case 20 may be protected from mechanical contact with the clip 30.

In addition, the gold or gold alloy plating layer formed on the contact layer 12 may prevent corrosion and galvanic corrosion caused by environmental changes.

The body 11 and the lower case 20 are formed of the same material or similar materials such as aluminum, an aluminum alloy, magnesium, or a magnesium alloy, the possibility of electrical and chemical changes is low at contact portions of the body 11 and the lower case 20.

Here, since there are various kinds of aluminum alloys and magnesium alloys, the term "similar" should be interpreted as indicating that materials having the same main metal component or similar properties are used.

In the present embodiment, the electric contact terminal 10 may have a circular plate shape with a diameter of about 1.2 mm to about 4.0 mm and a thickness of about 0.2 mm to 0.5 mm. However, the electric contact terminal 10 is not limited thereto.

The thickness of the electric contact terminal 10 may be equal to or similar to the depth of the accommodation recess 21, and thus the electric contact terminal 10 and the surface of the lower case 20 may have the same horizontal level or similar horizontal levels. For example, the accommodation recess 21 may have a depth of about 0.2 mm to about 0.5 mm.

The electric contact terminal 10 may be formed by forming the contact layer 12 on a sheet formed of aluminum, an aluminum alloy, magnesium, or a magnesium alloy, and performing a punching process on the sheet using a die. In this case, the body 11 and the projection 13 may be simultaneously formed by punching the sheet once.

Referring to FIG. 2A, the body 11 has an extending shape in which an edge (indicated with a dashed line) is shifted by a certain width from a circle, and the extending edge functions as the projection 13.

In the present embodiment, an inclined body portion 11*a* having a tapered shape may be formed by applying a C-cut shape to a lower edge of the body 11, and in this case, when the electric contact terminal 10 is surface mounted using a surface mounting apparatus, the contact terminal 10 may reliably be positioned on a taper 22 of the accommodation recess 21 and may easily be inserted into the accommodation recess 21.

In the present embodiment, the projection 13 is formed by outwardly extending an edge of the body 11, and if necessary, projections 13 may be formed by outwardly extending both lateral edges, or upper, lower, left, and right edges of the body 11. In addition, projections 13 may be formed by outwardly extending edge portions of the body 11 at intervals of 120 degrees with respect to the center of the body 11.

The width by which the edge of the body 11 is extended to form the projection 13 is not limited but may be adjusted such that the body 11 may be easily inserted into the accommodation recess 21 of the lower case 20 while being deformed by a small downward pressure.

The projection 13 may be formed together with the body 11 when the body 11 is formed using a press die.

In this manner, the electric contact terminal 10 may be easily inserted into the accommodation recess 21 by a small pressure applied during a surfacing mounting process, and may then be fixed such that the electric contact terminal 10 may not be moved or separated by a small force.

The accommodation recess 21 formed in the case 20 may be a circular recess corresponding to the plan shape of the body 11, and the diameter of the accommodation recess 21 may be equal to or slightly smaller than the diameter of the body 11 including the projection 13.

In this case, when the electric contact terminal 10 tapped on a reel carrier is fitted into the accommodation recess 21 through a vacuum pickup surface mounting process, since the area of the body 11 including the projection 13 is greater than the area of the accommodation recess 21, the projection 13 is placed on an entrance edge of the accommodation recess 21, and then the electric contact terminal 10 is forcibly inserted into the accommodation recess 21 as the projection 13 is deformed at the same time as the electric contact terminal 10 is surface mounted or by pressure applied by an additional mounting apparatus.

As described above, since the electric contact terminal 10 is mounted by physical force, the electric contact terminal 10 may not be easily separated from the accommodation recess 21 even when vibration or impact is applied to the electric contact terminal 10 while the lower case 20 is moved or handled.

Referring to FIG. 1, the taper 22 may be formed on the entrance edge of the accommodation recess 21 to smoothly insert the electric contact terminal 10 into the accommodation recess 21 by taking into account the dimensional tolerance of surface mounting and the dimensional tolerance of the electric contact terminal 10.

That is, when the electric contact terminal 10 is fitted into the accommodation recess 21 by a vacuum pickup surface mounting method, the taper 22 serves as a guide such that the electric contact terminal 10 may be easily inserted into the accommodation recess 21.

The inclination angle and size of the taper 22 may be appropriately adjusted by considering the dimensions of the body 11 and the projection 13 so as to easily insert the electric contact terminal 10 into the accommodation recess 21.

Referring to FIG. 1, after the body 11 is forcibly inserted into the accommodation recess 21, the adhesive 40 which is electrically conductive is applied between the body 11 and the accommodation recess 21. Specifically, the adhesive 40 may be applied to at least a gap between the lower surface of the body 11 and the bottom surface of the accommodation recess 21. The adhesive 40 may also be supplied to a gap between a lateral side of the body 11 and an inner lateral side of the accommodation recess 21.

The adhesive 40 is prepared by uniformly mixing electrically conductive powder such as copper, aluminum, silver, gold, or conductive carbon powder with an adhesive material such as an acrylic resin, an epoxy resin, or a silicone rubber, and as the adhesive 40 is cured, the electric contact terminal 10 may be bonded to the accommodation recess 21.

A given amount of the adhesive 40 may be ejected onto the bottom surface of the accommodation recess 21 by a dispenser or a printing method before the body 11 is press fitted into the accommodation recess 21, and then the body 11 may be forcibly fitted into the accommodation recess 21 and may be bonded to the bottom surface of the accommodation recess 21 by the adhesive 40. Alternatively, the body 11 may be dipped into the adhesive 40 to apply the adhesive 40 to surfaces of the body 11 including at least the lower surface of the body 11 and may then be press fitted into the accommodation recess 21. Alternatively, after the body 11 is press fitted into the accommodation recess 21, the adhesive 40 may be supplied to a gap between the body 11 and the accommodation recess 21 by a dispenser or a printing method. This will be described later.

The particle size of the powder of the adhesive 40 may be determined such that the electric contact terminal 10 may be easily placed in a horizontal direction in the accommodation recess 21. In some cases, the particle size of the power may be smaller than the gap between the lateral side of the body 11 and the inner lateral side of the accommodation recess 21 such that the adhesive 40 may easily permeate into the gap.

Figure 3:
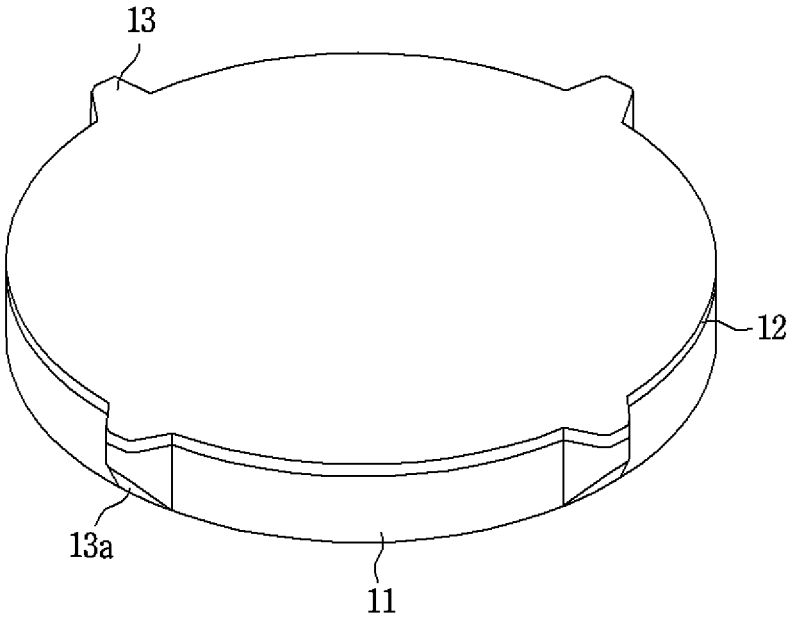
FIG. 3 is a perspective view illustrating an electric contact terminal according to another embodiment of the present invention.

FIG. 3 is a perspective view illustrating an electric contact terminal 10 according to another embodiment of the present invention.

In the present embodiment, the electric contact terminal 10 includes four projections 13 radially protruding from a lateral side of a body 11. For example, at least two projections 13 may be formed.

Unlike the previous embodiment, the body 11 has a circular shape, and the projections 13 protrude from the lateral side of the body 11.

When the accommodation recess 21 has a circular shape, the diameter of the accommodation recess 21 may be equal to or slightly greater than the diameter of the body 11 and may be slightly less than the length measured between ends of the projections 13. For example, the area of the accommodation recess 21 may be greater than the area of the body 11 by about 1% to about 10%.

In this case, when the electric contact terminal 10 tapped on a reel carrier is fitted into the accommodation recess 21 through a vacuum pickup surface mounting process, since the length between the ends of the projections 13 which protrude from the body 11 in one piece with the body 11 is greater than the diameter of the accommodation recess 21, the projections 13 is placed on the entrance edge of the accommodation recess 21, and then the body 11 is easily inserted into the accommodation recess 21 as the projections 13 are deformed at the same time as the electric contact terminal 10 is surface mounted or by pressure applied by an additional mounting apparatus. After the body 11 is inserted into the accommodation recess 21, only a small gap remains in the accommodation recess 21, and thus wobbling of the body 11 may reduce.

As described later, while the body 11 is surface mounted using a surface mounting apparatus, the body 11 may be slightly inserted into the accommodation recess 21 by pressing the body 11 with a pressing jig of the surface mounting apparatus, or after the body 11 is surface mounted, the body 11 may be inserted into the accommodation recess 21 at once by pressing the body 11 using an additional pressing jig.

Referring to FIG. 3, the four projections 13 are formed at intervals of 90 degrees. In another embodiment, three projections 13 may be formed at intervals of 120 degrees by considering stable balance.

One or more projections 13 may protrude for smooth reel taping and balanced insertion, and the projections 13 may have a uniform size and may be arranged at regular intervals along the edge of the body 11 so that when the body 11 is surface mounted by vacuum pickup, the body 11 may be horizontally placed. For example, the projections 13 may have the same shape.

In the present embodiment, inclined projection portions 13*a* having a tapered shape may be formed on lower edge portions of the projections 13 by applying a C-cut shape to the lower edge portions of the projections 13.

When the electric contact terminal 10 is surface mounted using a surface mounting apparatus, the electric contact terminal 10 may be reliably placed on the taper 22 of the accommodation recess 21 owing to the inclined projection portions 13*a*, and after the electric contact terminal 10 is surface mounted, the electric contact terminal 10 may be easily inserted into the accommodation recess 21 using a small amount of force.

The projections 13 may have various shapes. For example, the projections 13 may be relatively thick at a portion connected to the body 11 and relatively thin at an end thereof such that the projections 13 may not be easily torn at boundaries with the body 11 but may be easily deformed, or the projections 13 may have a fin shape.

The dimensions of the projections 13 are not particularly limited, but may be adjusted such that the projections 13 may be easily inserted into the accommodation recess 21 of the case 20 while being deformed by a small downward pressure.

Figure 4A:
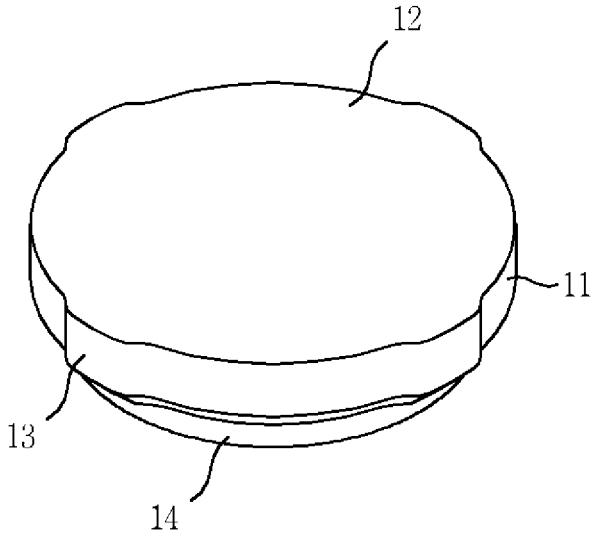
FIGS. 4A and 4B are a perspective view and a bottom perspective view illustrating an electric contact terminal according to another embodiment of the present invention.
Figure 4B:
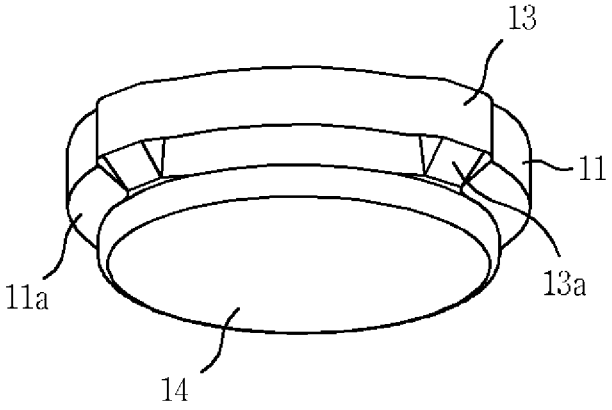
Figure 5A:
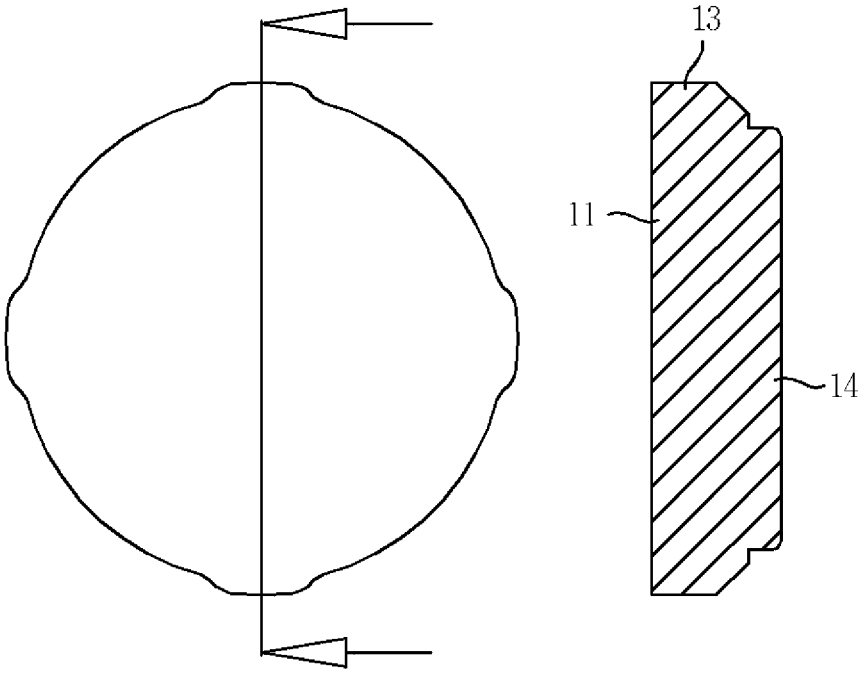
FIGS. 5A and 5B are a cross-sectional view taken along a line including projections of the electric contact terminal and a cross-sectional view taken along a line not including the projections of the electric contact terminal.
Figure 5B:
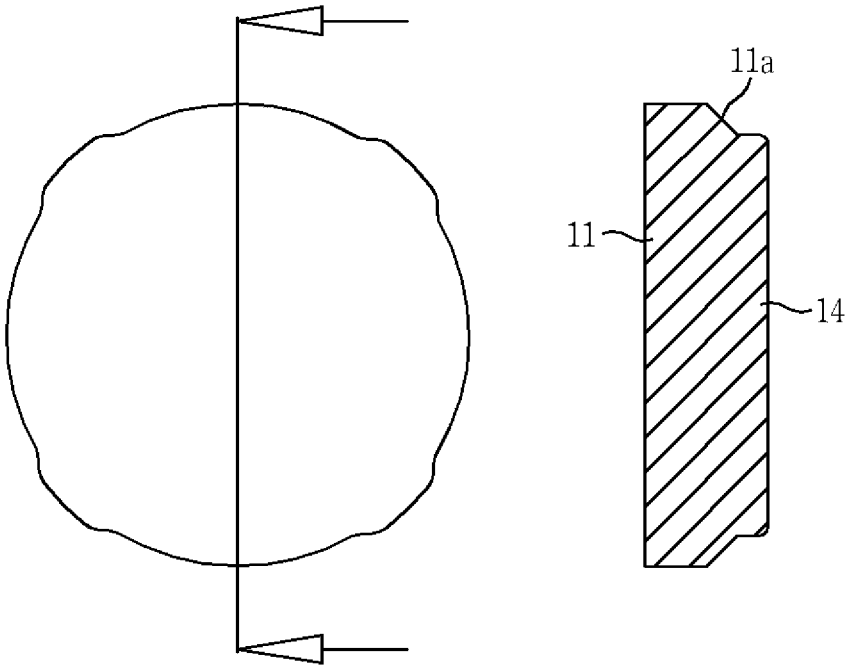

FIG. 4A is a perspective view illustrating an electric contact terminal 10 according to another embodiment of the present invention, FIG. 4B is a bottom perspective view illustrating the electric contact terminal 10, and FIGS. 5A and 5B are a cross-sectional view taken along a line including projections 13 of the electric contact terminal 10 and a cross-sectional view taken along a line not including the projections 13 of the electric contact terminal 10.

The electric contact terminal 10 includes: a one-piece body including a body 11 at a vertically upper position and a body 14 having a diameter smaller than the diameter of the body 11; at least two projections 13 radially protruding from a lateral side of the body 11; a contact layer 12 formed on at least a portion of the body 11 to be brought into contact with the clip 30; and an adhesive 40 that bonds the body 14 to the accommodation recess 21. The contact layer 12 includes at least nickel.

In the present embodiment, a C-cut shape is applied to the body 11 at a boundary with between the body 11 and the body 14 to form an inclined body portion 11*a*, and the projections 13 may have the same lateral contour as the inclined body portion 11*a*.

Alternatively, instead of applying a C-cut shape to a lower end of the body 11, a C-cut shape may be applied to lower ends of the projections 13 to form inclined projection portions 13*a*.

Four projections 13 are formed at intervals of 90 degrees along the lateral side of the body 11. In another embodiment, three projections 13 may be formed at intervals of 120 degrees by considering stable balance.

One or more projections 13 may protrude for smooth reel taping and balanced insertion, and the projections 13 may have a uniform size and may be arranged at regular intervals along the lateral side of the body 11 so that when the electric contact terminal 10 is surface mounted by vacuum pickup, the electric contact terminal 10 may be horizontally placed.

The projections 13 may be variously shaped, and factors such as the number, thickness, and width of the projections 13 may be variously designed by considering force to be applied to insert the electric contact terminal 10 into the case 20 and remove the electric contact terminal 10 from the case 20.

The dimensions of the projections 13 are not particularly limited, but may be adjusted such that the projections 13 may be easily inserted into the accommodation recess 21 of the case 20 while being deformed by proper downward pressure. In addition, the projections 13 may have the same shape.

The diameter of the body 14 may be smaller than the diameter of the accommodation recess 21 such that the body 14 may be easily inserted into the accommodation recess 21, and the diameter of the body 11 may be equal to or slightly less than the diameter of the accommodation recess 21 such that the inclined projection portions 13*a* of the projections 13 may be placed on the entrance edge of the accommodation recess 21.

As a result, when the projections 13 are forcibly inserted into the accommodation recess 21, the projections 13 may be brought into tight contact with the inner lateral side of the accommodation recess 21 while being deformed, thereby fitting the electric contact terminal 10 into the accommodation recess 21. In this case, separation of the projections 13 from the accommodation recess 21 may be effectively prevented because the number, height, and width of the projections 13 are properly designed.

Hereinafter, a process of forcibly press-fitting the electric contact terminal 10 into the accommodation recess 21 of the case 20 will be described.

Figure 6A:
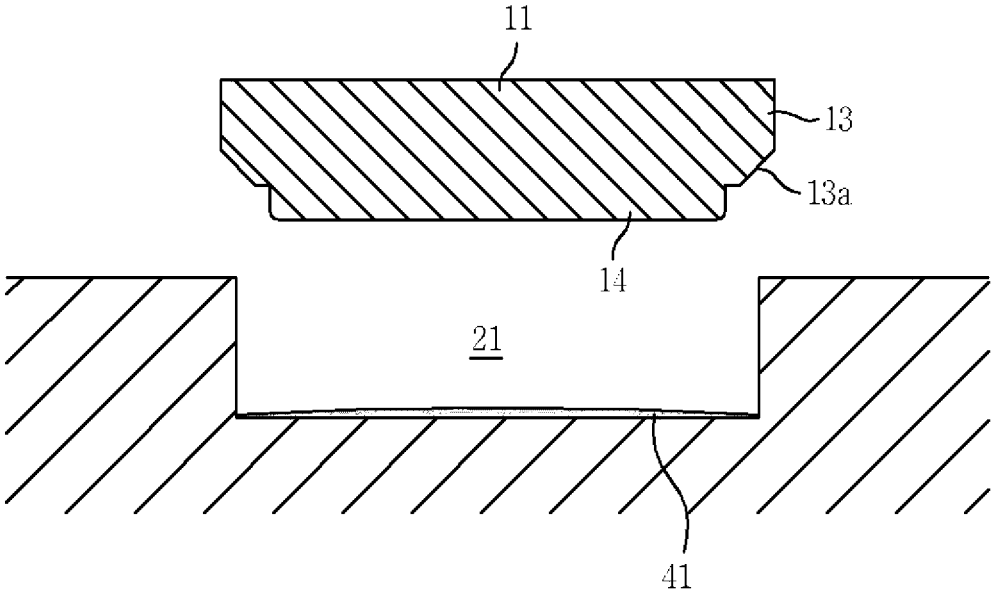
FIGS. 6A to 6C are cross-sectional views illustrating how the electric contact terminal is press fitted into an accommodation recess of a case.
Figure 6B:
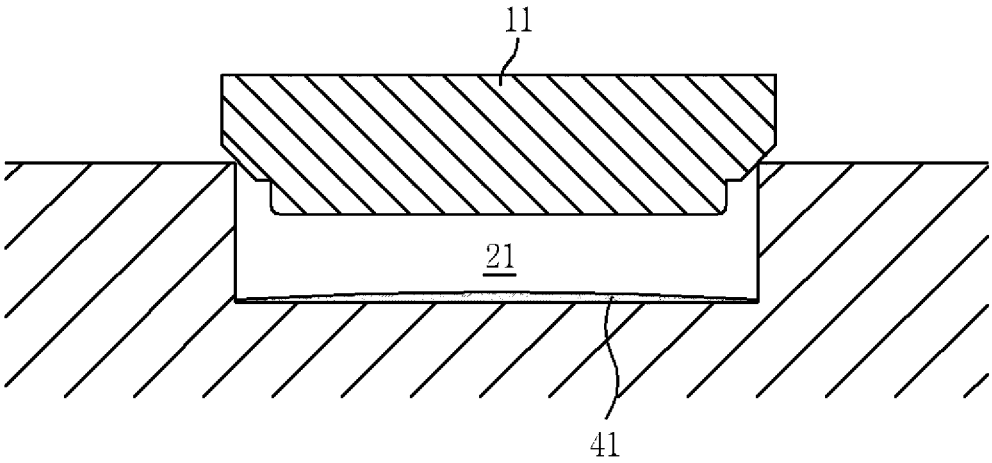
Figure 6C:
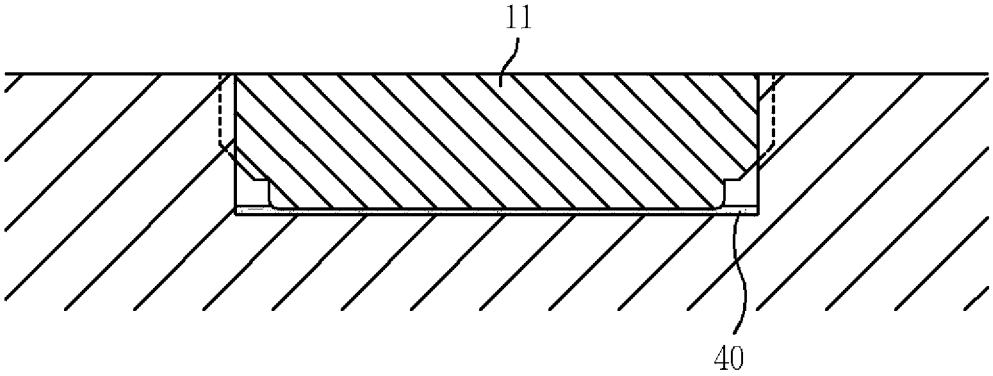
Figure 7A:
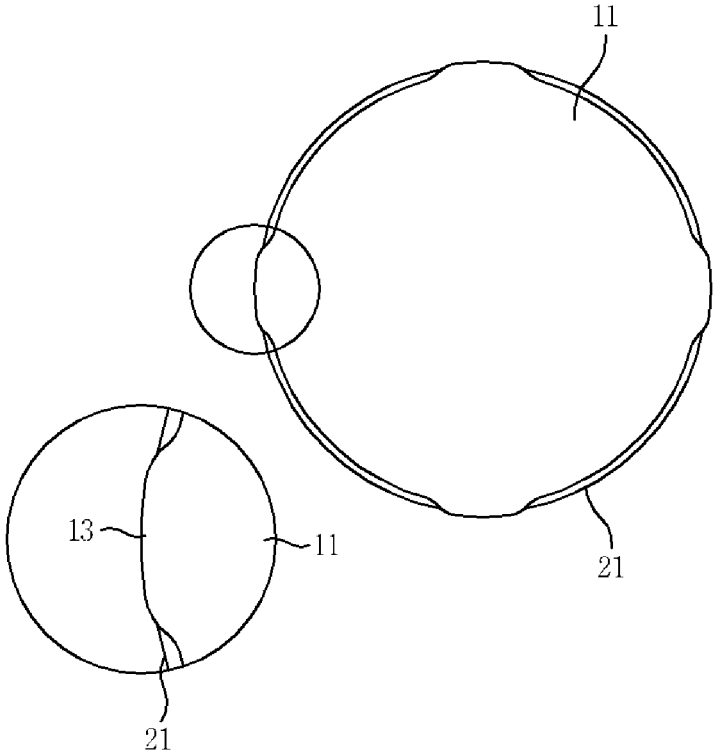
FIGS. 7A and 7B are plan views illustrating the electric contact terminal before and after the electric contact terminal 10 is inserted into the accommodation recess.
Figure 7B:
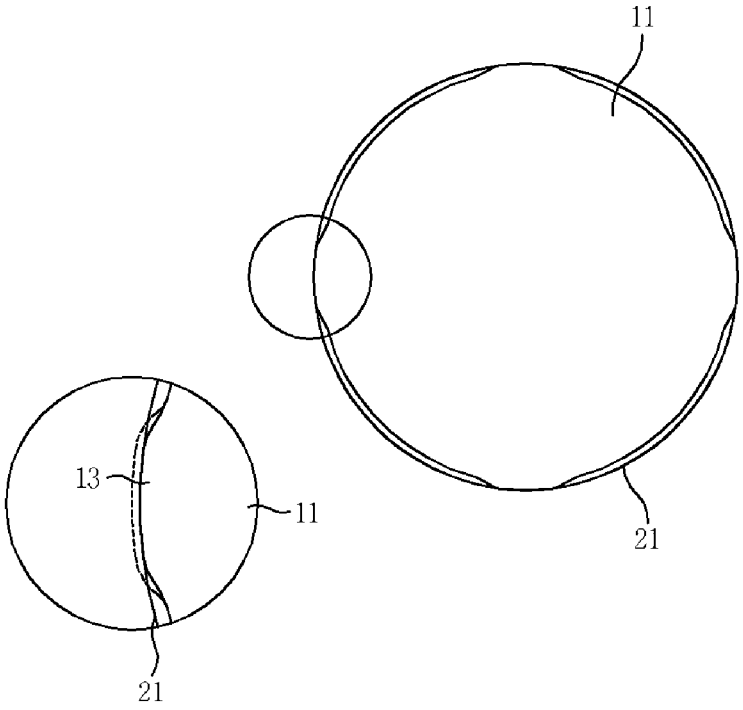

FIGS. 6A to 6C are cross-sectional views illustrating how the electric contact terminal 10 is press fitted into the accommodation recess 21 of the case 20, and FIGS. 7A and 7B are plan views illustrating the electric contact terminal 10 before and after the electric contact terminal 10 is inserted into the accommodation recess 21.

First, a liquid adhesive 41 is applied to the bottom surface of the accommodation recess 21 by a dispensing method or a printing method.

When applying the liquid adhesive 41, the amount of the liquid adhesive 41 may be appropriately adjusted. For example, the amount of the liquid adhesive 41 may be adjusted such that the liquid adhesive 41 may be filled in a gap between a lateral side of the body 14 and an inner surface of the accommodation recess 21 or may only be filled in a gap between a lower surface of the body 14 and the bottom surface of the accommodation recess 21.

Thereafter, the electric contact terminal 10 tapped on a reel carrier is fed, and a vacuum pickup device picks up the electric contact terminal 10 by creating a vacuum on the contact layer 12 and mount the electric contact terminal 10 on the accommodation recess 21.

Then, the body 14 of the electric contact terminal 10 is inserted into the accommodation recess 21, and the inclined projection portions 13*a* of the projections 13 is placed on the entrance edge of the accommodation recess 21 such that the electric contact terminal 10 may not be pushed in a horizontal direction.

After the contact terminal 10 is mounted on the accommodation recess 21, the body 11 is pressed by a pressing tool of the vacuum pickup device to forcibly insert the body 11 into the accommodation recess 21. Alternatively, after the electric contact terminal 10 is surface mounted, the body 11 may be pressed at one by using an additional jig to forcibly insert the body 11 into the accommodation recess 21.

As a result, as shown with dashed lines in FIGS. 6C and 7B, the electric contact terminal 10 is fully inserted into the accommodation recess 21 as the projections 13 of the electric contact terminal 10 are deformed or crushed.

In the present embodiment, the inclined body portion 11*a* is formed on the lower end of the body 11, the projections 13 protrude along the lateral contour of the body 11 including the inclined body portion 11*a*. Thus, the body 11 does not make contact with the inner lateral side of the accommodation recess 21. In addition, since the body 14 has a smaller diameter the body 11, the body 14 also does not make contact with the inner lateral side of the accommodation recess 21.

Id pressing force is not uniformly applied to the entire upper surface of the electric contact terminal 10, the electric contact terminal 10 may be inserted into the accommodation recess 21 in an inclined state, and thus portions of the body 11 and the body 14 may come into contact with the inner lateral side of the accommodation recess 21.

As described above, since the mechanical hardness of the projections 13 is equal to or less than the mechanical hardness of the case 20 in which the accommodation recess 21 is formed, the projections 13 may be effectively deformed.

Even if the mechanical hardness of the projections 13 is equal to or similar to the mechanical hardness of the case 20, since the inner lateral wall of the accommodation recess 21 is formed in one piece whereas the projections 13 are spaced apart from each other, the projections 13 having a relatively small size may be deformed or crushed and may be easily inserted into the accommodation recess 21.

Furthermore, in a state in which the electric contact terminal 10 is forcibly press fitted into the accommodation recess 21 and mechanically coupled to the accommodation recess 21 by the projections 13, the liquid adhesive 41 filled in the gap between the lower surface of the body 14 and the bottom surface of the accommodation recess 21 is cured, and thus the electric contact terminal 10 may be bonded to the accommodation recess 21 and may be securely prevented from being separated from the accommodation recess 21.

In other words, since the electric contact terminal 10 is bonded to the accommodation recess 21 as the liquid adhesive 41 is cured, the electric contact terminal 10 may be securely prevented from being separated from the accommodation recess 21 by impact or vibration owing to the mechanical coupling between the accommodation recess 21 and the projections 13 forcibly press fitted into the accommodation recess 21 and the adhesive coupling by the adhesive 40.

In addition, since the projections 13 are brought into tight contact with the inner surface of the accommodation recess 21 as being deformed, it is possible to provide electrical connection and decrease electrical resistance owing to the adhesive 40 having electrical conductivity.

Alternatively, the body 14 may be dipped into the adhesive 40 to apply the adhesive 40 to surfaces of the body 14 including at least the lower surface of the body 14 and may then be press fitted into the accommodation recess 21 to obtain the same effect of bonding the electric contact terminal 10 to the accommodation recess 21.

As described above, the contact layer 12 may be formed by plating the entire surface of the electric contact terminal 10 sequentially with nickel and gold.

According to this structure, when the contact terminal 10 is inserted into the accommodation recess 21, since the contact layer 12 is brought into contact with the lateral wall and bottom surface of the accommodation recess 21, corrosion and galvanic corrosion caused by environmental variations may be reduced.

Figure 8A:
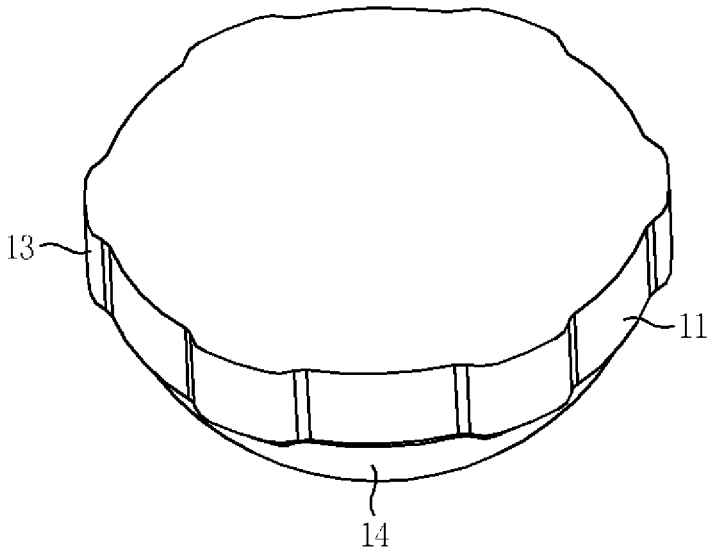
FIG. 8A is a perspective view illustrating an electric contact terminal according to another embodiment of the present invention.
Figure 8B:
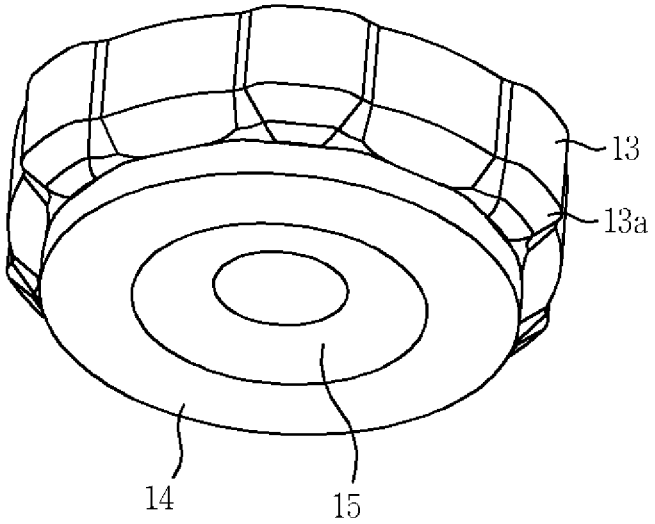
FIG. 8B is a bottom perspective view illustrating the electric contact terminal.
Figure 8C:
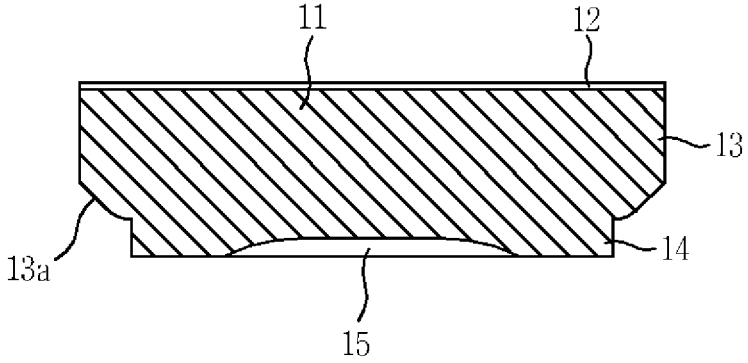
FIG. 8C is a cross-sectional view taken along a line including projections of the electric contact terminal.

FIG. 8A is a perspective view illustrating an electric contact terminal 10 according to another embodiment of the present invention, FIG. 8B is a bottom perspective view illustrating the electric contact terminal 10, and FIG. 8C is a cross-sectional view taken along a line including projections of the electric contact terminal 10.

In the present embodiment, a flat hemispherical recess 15 is formed in a lower center portion of a body 14, and the recess 15 has a circular horizontal cross-section and a diameter decreasing in a direction toward the center of the body 14.

According to this structure, the contact area between the lower surface of the body 14 and the bottom surface of the accommodation recess 21 may be increased, thereby improving the bonding strength therebetween.

In addition, a remaining portion of a liquid adhesive 41 applied to the bottom surface of the accommodation recess 21 may be filled in the recess 15, and thus the bonding strength between the electric contact terminal 10 and the accommodation recess 21 may be improved.

In addition, since the recess 15 functions as a buffer space accommodating a remaining portion of the liquid adhesive 41, the liquid adhesive 41 may be uniformly distributed between the lower surface of the body 14 and the bottom surface of the accommodation recess 21.

Figure 9:
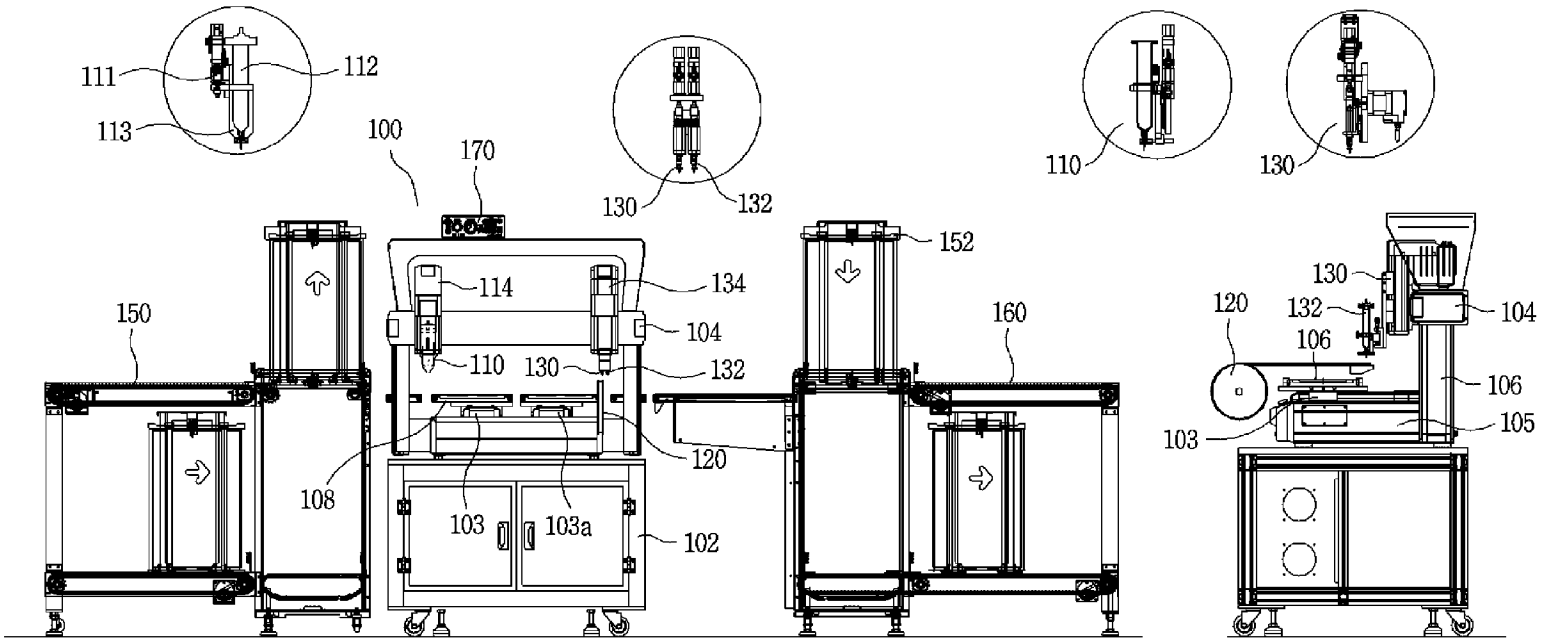
FIG. 9 illustrates a front view and a side view of a mounting apparatus according to an embodiment of the present invention.

FIG. 9 illustrates a front view and a side view of a mounting apparatus 100 according to an embodiment of the present invention.

The mounting apparatus 100 includes: a dispenser 110 configured to discharge a predetermined amount of an adhesive 40 to an accommodation recess 21 of the case 20; a tape carrier 120 configured to sequentially supply electric contact terminals 10; a pick-and-place device 130 configured to pick up an electric contact terminal 10 from the tape carrier 120, place the electric contact terminal 10 on an entrance of the accommodation recess 21 of the case 20, and press the electric contact terminal 10 into the accommodation recess 21; and a pusher 132 configured to press the electric contact terminal 10 placed on the entrance of the accommodation recess 21 from an upper side to insert the electric contact terminal 10 into the accommodation recess 21.

Hereinafter, the mounting apparatus 100 for mounting electric contact terminals 10 will be described according to the embodiment of the present invention.

A magazine loader 150 and a magazine unloader 160 are arranged respectively at front and rear sides of the mounting apparatus 100.

A plurality of jigs 108 are loaded on cassette magazines 152, and objects such as metal cases of cellular phones on which the electric contact terminals 10 will be mounted are arranged and fixed at predetermined positions of the jigs 108.

The cassette magazines 152 are loaded on the magazine loader 150, and the jigs 108 are supplied one by one to a bed 103 provided in the mounting apparatus 100 as being pushed by a cylinder of the magazine loader 150.

Likewise, after the electric contact terminals 10 are mounted on the cases, the jigs 108 to which the cases are fixed are sequentially loaded on cassette magazines 152 of the magazine unloader 160 and are discharged.

The mounting apparatus 100 is provided with a support table 102 on which a base 105 is installed, and columns 106 are installed on both lateral sides of the base 105 in a state in which upper ends of the columns 106 are connected through a bar frame 104.

A mount 114 of the dispenser 110, and a mount 134 of the pick-and-place device 130/pusher 132 are fixed to the bar frame 104.

A pair of beds 103 and 103*a* are movably installed on the base 105 at positions respectively corresponding to the dispenser 110 and the pick-and-place device 130/pusher 132.

The following description will be given with reference to FIG. 9 by defining a left-right direction as an X direction, a font-rear direction as a Y direction, and a vertical direction as a Z direction.

The mount 114 to which the dispenser 110 is fixed and the mount 134 to which the pick-and-place device 130/pusher 132 are fixed are moved in the X direction, the dispenser 110 and the pick-and-place device 130/pusher 132 are moved in the Z direction, and the beds 103 and 103*a* supporting the jigs 108 are moved in the Y direction such that the dispenser 210 and the pick-and-place device 130/pusher 132 may be moved like a three-axis robot with respect to cases 20 fixed to the jigs 108.

In the dispenser 110, a syringe 112 containing the liquid adhesive and a hydraulic cylinder 111 are coupled to a bracket 113, and the bracket 113 is fixedly coupled to the mount 114. The cylinder 111 is driven under the control of a control unit 170 so as to discharge a predetermined amount of the liquid adhesive from the syringe 112.

In this case, a program for driving the mounting apparatus 100 is embedded in the control unit 170 so that entire processes may be sequentially and continuously performed.

The pick-and-place device 130 has a function of picking up an electric contact terminal 10 by vacuum and placing the electric contact terminal 10 on the entrance of the accommodation recess 21, and the pusher 132 has a function of pressing the electric contact terminal 10 to insert the electric contact terminal 10 into the accommodation recess 21 of the case 20.

The pick-and-place device 130 and the pusher 132 are operated by a separate cylinder, but are coupled to the same mount 134 and are moved together.

Unlike in the present embodiment, the pusher 132 may be omitted, and the pick-and-place device 130 may have a function of picking up an electric contact terminal 10 and placing the electric contact terminal 10 and also a function of pressing the electric contact terminal 10. This may require a precondition that the electric contact terminal 10 has a shape and structure for being sufficiently inserted into the accommodation recess 21 as being pressed by only the pick-and-place device 130.

In this case, the adhesive discharged by the dispenser 110 into the accommodation recess 21 may have initial self adhesiveness, and thus the electric contact terminal 10 inserted into the accommodation recess 21 may be temporarily fixed by the self adhesiveness of the adhesive.

The tape carrier 120 in which electric contact terminals 10 are taped on a reel is supplied, and the pick-and-place device 130 picks up the electric contact terminals 10 one by one by a vacuum pickup method. Then, the electric contact terminals 10 are placed on accommodation recesses 21 of cases 20.

Hereinafter, the operation of the mounting apparatus 100 having the above structure will be described.

The cylinder of the magazine loader 150 supplies a plurality of jigs 108 one by one to the bed 103 of the mounting apparatus 100 by pushing the jigs 108 from the cassette magazine 152 loaded with the jigs 108 on which metal cases 20 are arranged and fixed at given positions.

In this embodiment, the beds 103 and 103*a* may be provided as a pair so that a dispensing operation, a pick-and-place operation, and an insertion operation may be independently performed. If the speed of operations is not a matter of concern, operations may be sequentially performed using a single bed.

When a jig 108 is supplied to the bed 103 from the magazine loader 150 for the first time, the control unit 170 controls the cylinder 111 of the dispenser 110 to discharge a predetermined amount of a liquid adhesive contained in the syringe 112 to a discharge position.

Since the discharge position corresponds to the position of the accommodation recess 21 of the case 20 fixed to the jig 108, the position of the accommodation recess 21 is previously inputted and stored, and the control unit 170 reads the position to control the movement of the mount 114 in the Y direction, the movement of the dispenser 110 in the Z direction, and the movement of the bed 103 in the X direction such that the predetermined amount of the liquid adhesive may be exactly discharged to the bottom surface of the accommodation recess 21.

After the liquid adhesive is discharged, the jig 108 is moved under the control of the control unit 170 to the bed 103*a* corresponding to the pick-and-place device 130/pusher 132 before the discharged adhesive is cured such that an electric contact terminal 10 may be inserted into the accommodation recess 21 of the case 20.

After the jig 108 loaded with the case 20 in which the adhesive is discharged to the accommodation recess 21 is mounted on the bed 103*a*, the control unit 170 controls the pick-and-place device 130 to pick up an electric contact terminal 10 from the tape carrier 120 by vacuum and place the electric contact terminal 10 on the entrance of the accommodation recess 21 of the case 20 and controls the pusher 132 to insert the electric contact terminal 10 into the accommodation recess 21 by pressing the electric contact terminal 10.

After the electric contact terminal 10 is picked up by the pick-and-place device 130 from the tape carrier 120, the electric contact terminal 10 may pass through a vision unit (not shown) to check whether the electric contact terminal 10 is exactly picked up. The vision unit may be installed at a position adjacent to the tape carrier 120.

The pick-and-place operation and the insertion operation are sequentially performed on cases 20 one by one to insert electric contact terminals 10 into the accommodation recesses 21 of all the cases 20 fixed to the jig 108, and then the jig 108 is loaded again on the cassette magazine 152 of the magazine unloader 160 and is then discharged to the outside.

In addition, the jig 108 is moved to an adjacent bed 103 after the dispensing operation is performed as described above, and then a new jig 108 is supplied from the magazine loader 150 to an empty bed 103 located under the dispenser 110.

The electric contact terminal 10 inserted into the accommodation recess 21 of the case 20 mounted on the jig 108 discharged from the mounting apparatus 100 is physically coupled to the case 20, and as the discharged liquid adhesive is cured, the electric contact terminal 10 is bonded to the case 20.

Figure 10:
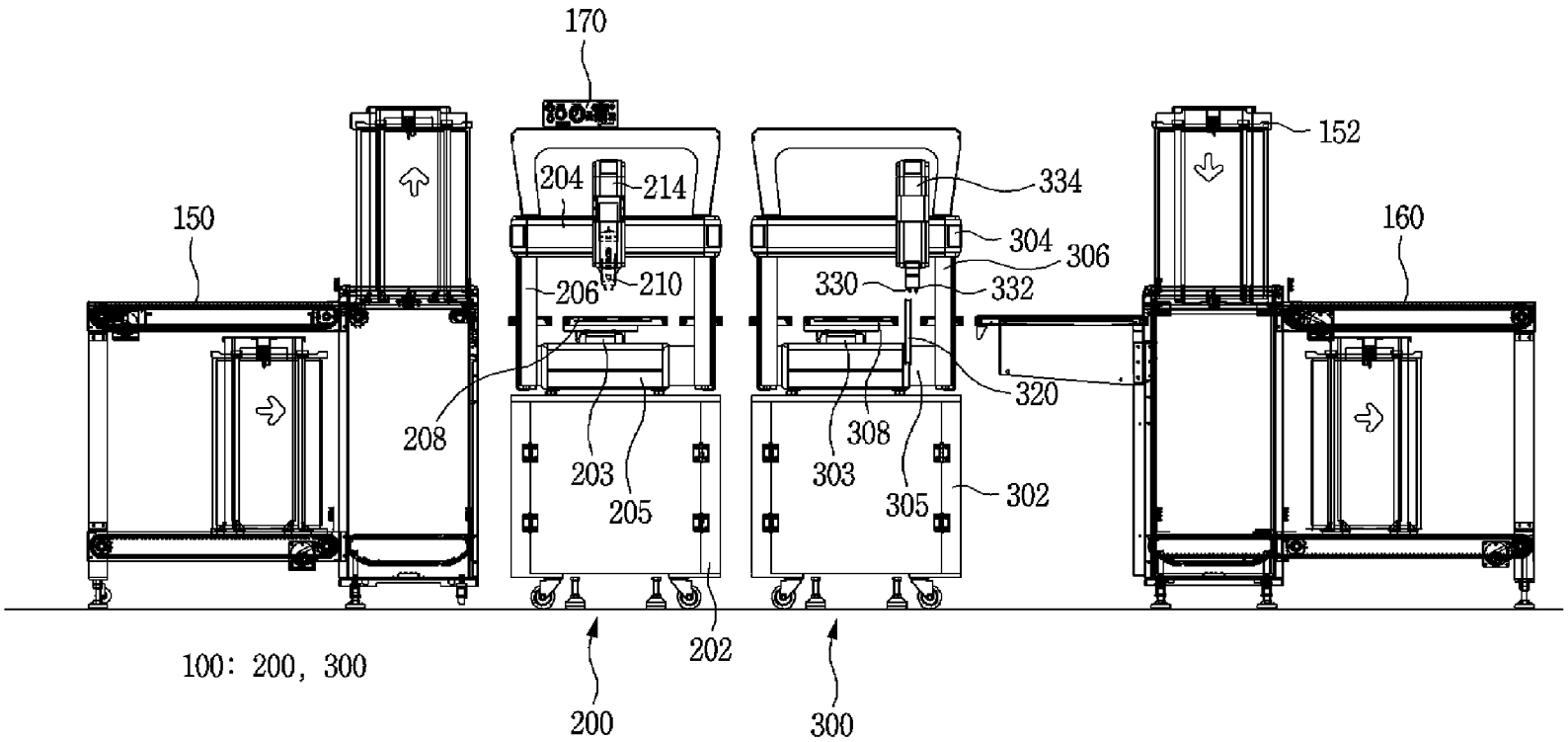
FIG. 10 is a front view illustrating a mounting apparatus according to another embodiment of the present invention.

FIG. 10 is a front view illustrating a mounting apparatus 100 according to another embodiment of the present invention.

The mounting apparatus 100 includes: a dispenser 210 configured to discharge a predetermined amount of an adhesive 40 to an accommodation recess 21 of the case 20; a tape carrier 320 configured to sequentially supply electric contact terminals 10; a pick-and-place device 330 configured to pick up an electric contact terminal 10 from the tape carrier 320, place the electric contact terminal 10 on an entrance of the accommodation recess 21 of the case 20, and press the electric contact terminal 10 into the accommodation recess 21; and a pusher 332 configured to press the electric contact terminal 10 placed on the entrance of the accommodation recess 21 from an upper side to insert the electric contact terminal 10 into the accommodation recess 21.

The mounting apparatus 100 includes a dispensing unit 200 and a mounting unit 300 that are independently constructed and continuously arranged. The dispensing unit 200 includes the dispenser 210, and the mounting unit 300 includes the pick-and-place device 330 and the pusher 332.

Hereinafter, the mounting apparatus 100 for mounting electric contact terminals 10 will be described according to the other embodiment of the present invention.

In the previous embodiment, a magazine loader 150 and a magazine unloader 160 are arranged respectively at front and rear sides of the mounting apparatus 100, and thus detailed descriptions thereof will not be presented here.

The mounting apparatus 100 includes the dispensing unit 200 and the mounting unit 300 sequentially arranged between the magazine loader 150 and the magazine unloader 160.

The dispensing unit 200 and the mounting unit 300 have the same structure except that the dispensing unit 200 includes the dispenser 210, and the mounting unit 300 include the pick-and-place device 330 and the pusher 332.

Specifically, the dispensing unit 200 includes a support table 202 on which a base 205 is installed, and columns 206 are installed on both lateral sides of the base 105 in a state in which upper ends of the columns 206 are connected through a bar frame 204 and a mount 214 of the dispenser 210 is fixed to the bar frame 204.

Similarly, the mounting unit 300 includes a support table 302 on which a base 305 is installed, and columns 306 are installed on both lateral sides of the base 305 in a state in which upper ends of the columns 306 are connected through a bar frame 304 and a mount 334 provided with the pick-and-place device 330 and the pusher 332 is fixed to the bar frame 304.

As in the embodiment shown in FIG. 9, the mount 214 to which the dispenser 210 is fixed is moved in the X direction, the dispenser 210 is moved in the Z direction, and a bed 203 supporting a jig 208 is moved in the Y direction such that the dispenser 210 may be moved like a three-axis robot with respect to the case 20 fixed to the jig 208.

Similarly, the mount 314 to which the pick-and-place device 330 and the pusher 332 are fixed is moved in the X direction, the pick-and-place device 330 and the pusher 332 are moved in the Z direction, and a bed 303 supporting a jig 308 is moved in the Y direction such that the pick-and-place device 330 and the pusher 332 may be moved like a three-axis robot with respect to the case 20 fixed to the jig 308.

The dispenser 210, the pick-and-place device 330 and the pusher 332, and the tape carrier 320 have the same structures as those described in the previous embodiment, and thus detailed descriptions thereof will not be prevented here.

Hereinafter, the operation of the mounting apparatus 100 having the above structure will be described according to the other embodiment.

The cylinder of the magazine loader 150 supplies a plurality of jigs 208 one by one to the bed 203 of the dispensing unit 200 of the mounting apparatus 100 from the cassette magazine 152 loaded with the jigs 208 on which metal cases 20 are arranged and fixed at given positions.

When a jig 208 is supplied to the bed 203 of the dispensing unit 200 from the magazine loader 150 for the first time, a control unit 170 controls a cylinder 211 of the dispenser 210 to discharge a predetermined amount of a liquid adhesive contained in a syringe 212 to a discharge position.

Since the discharge position corresponds to the position of the accommodation recess 21 of the case 20 fixed to the jig 208, the position of the accommodation recess 21 is previously inputted and stored, and the control unit 170 reads the position to control the movement of the mount 214 of the dispensing unit 200 in the Y direction, the movement of the dispenser 210 in the Z direction, and the movement of the bed 203 in the X direction such that the predetermined amount of the liquid adhesive may be exactly discharged to the bottom surface of the accommodation recess 21.

After the liquid adhesive is discharged to the accommodation recess 21 of the case 20, the jig 208 is moved under the control of the control unit 170 to the mounting unit 300 before the discharged adhesive is cured such that the electric contact terminal 10 may be inserted into the accommodation recess 21 of the case 20.

After the jig 308 loaded with the case 20 in which the adhesive is discharged to the accommodation recess 21 is mounted on the bed 303, the control unit 170 controls the pick-and-place device 330 of the mounting unit 300 to pick up an electric contact terminal 10 from the tape carrier 320 by vacuum and place the electric contact terminal 10 on the entrance of the accommodation recess 21 of the case 20 and controls the pusher 332 to insert the electric contact terminal 10 into the accommodation recess 21 by pressing the electric contact terminal 10.

Like in the embodiment shown in FIG. 9, after an electric contact terminal 10 is picked up from the tape carrier 320 by vacuum, whether the electric contact terminal 10 is exactly picked up may be checked while the electric contact terminal 10 passes through a vision unit.

The pick-and-place operation and the insertion operation are sequentially performed on cases 20 one by one to insert electric contact terminals 10 into the accommodation recesses 21 of all the cases 20 fixed to the jig 308, and then the jig 308 is loaded again on the cassette magazine 152 of the magazine unloader 160 and is then discharged to the outside.

In addition, the jig 208 is moved to the adjacent mounting unit 300 after the dispensing operation is performed as described above, and then a new jig 208 is supplied from the magazine loader 150 to an empty bed 203 located under the dispenser 210.

The electric contact terminal 10 inserted into the accommodation recess 21 of the case 20 mounted on the jig 308 discharged from the mounting unit 300 is physically coupled to the case 20, and as the discharged liquid adhesive is cured, the electric contact terminal 10 is bonded to the case 20.

In the present embodiment, the dispensing unit 200 and the mounting unit 300 are arranged as separate mechanisms, and thus when one of the dispensing unit 200 and the mounting unit 300 is abnormal, the other may be used instead of the abnormal one, thereby improving the efficiency of production.

Those of ordinary skill in the art may make changes or modifications from the above description without departing from the spirit and scope of the present invention. Therefore, the embodiments of the present invention are for illustrative purposes only and are not intended to limit the scope of the present invention. The scope of the present invention should be construed according to the appended claims, and it should be understood that all technical ideas equivalent to those described above are within the scope of the present invention.

What is claimed is:

1. An electric contact terminal configured to be inserted into an accommodation recess of a metal case, the electric contact terminal comprising:

a metal body having a flat surface on at least an upper side thereof; and at least two projections protruding from a lateral side of the body, wherein the projections are sized such that the projections are placed on an edge of the accommodation recess, and the electric contact terminal is press fitted into the accommodation recess by physically pressing the projections to deform the projections.

2. The electric contact terminal of claim 1, wherein the body is a one-piece body comprising a first body at a vertically upper position and a second body having a smaller diameter than the first body.

3. The electric contact terminal of claim 2, wherein a C-cut shape is applied to the first body at a boundary between the first body and the second body to form an inclined body portion, and the projections protrude along a lateral contour of the first body and have the same height.

4. The electric contact terminal of claim 1, wherein the projections are electrically and mechanically coupled to an inner lateral side of the accommodation recess as the projections are brought into contact with the inner lateral side of the accommodation recess.

5. The electric contact terminal of claim 1, wherein inclined projection portions having a tapered shape are formed at lower edges of the projections such that the projections have a gradually decreasing height.

6. The electric contact terminal of claim 1, wherein a recess is formed in a lower center portion of the body, and the recess is a flat hemispherical recess having a circular horizontal cross-section and a diameter decreasing in a direction toward a center of the body.

7. The electric contact terminal of claim 1, wherein a contact layer having greater hardness than the body is formed on the upper side of the body.

* * * * *